US007290892B2

(12) United States Patent
Shieh

(10) Patent No.: US 7,290,892 B2
(45) Date of Patent: Nov. 6, 2007

(54) ANGLE ADJUSTABLE MIRROR SUPPORT

(75) Inventor: Ming-Dang Shieh, Lu Kang (TW)

(73) Assignee: Horng Lai Industrial Co., Ltd., Changhua Hsien (TW)

( * ) Notice: Subject to any disclaimer, the term of this patent is extended or adjusted under 35 U.S.C. 154(b) by 112 days.

(21) Appl. No.: 11/258,512

(22) Filed: Oct. 25, 2005

(65) Prior Publication Data

US 2007/0091490 A1 Apr. 26, 2007

(51) Int. Cl.
*G02B 5/08* (2006.01)
*G02B 7/182* (2006.01)

(52) U.S. Cl. ..... 359/872; 359/881; 248/476; 248/477; 248/486

(58) Field of Classification Search ..... 359/850, 359/854, 871, 872, 881; 248/469, 470, 471, 248/472, 473, 474, 476, 479, 486, 475.1, 248/477, 478

See application file for complete search history.

(56) References Cited

U.S. PATENT DOCUMENTS 848,624 A * 4/1907 Bell ..... 248/477
1,422,685 A * 7/1922 Fitchet ..... 359/854
1,864,015 A * 6/1932 Fotakis ..... 359/607
2,117,403 A * 5/1938 Crosby ..... 359/880
2,266,977 A * 12/1941 Lynch ..... 359/880
3,148,461 A * 9/1964 Johnson ..... 434/185
4,575,200 A * 3/1986 Humiston ..... 359/849
4,759,621 A * 7/1988 Hawkins ..... 359/862
5,124,858 A * 6/1992 Goetz ..... 359/872
5,997,147 A * 12/1999 Tatoian ..... 359/856
6,059,417 A * 5/2000 Tatoian ..... 359/856
6,650,453 B2 * 11/2003 Takase ..... 359/198
6,955,329 B1 * 10/2005 Shieh ..... 248/466

* cited by examiner

*Primary Examiner*—Ricky D. Shafer
(74) *Attorney, Agent, or Firm*—Alan Kamrath; Kamrath & Associates P.A.

(57) ABSTRACT

An angle adjustable mirror support for a bathroom includes a mirror, a shaft mounted on the frame of the mirror, two connecting members each mounted on the frame of the mirror and each secured to the respective end of the shaft, two fixing seats each mounted on the respective connecting member, and two locking members each mounted on the respective fixing seat and each secured to the respective connecting member. Thus, the shaft has two ends each rested on the inner face of the respective side of the frame of the mirror, so that the shaft is mounted on the frame of the mirror easily without the possibility of breaking the mirror face of the mirror.

16 Claims, 8 Drawing Sheets

ANGLE ADJUSTABLE MIRROR SUPPORT

BACKGROUND OF THE INVENTION

1. Field of the Invention

The present invention relates to a mirror support for a bathroom, and more particularly to an angle adjustable mirror support for a bathroom.

2. Description of the Related Art

A conventional mirror support for a bathroom in accordance with the prior art shown in FIGS. 6-8 comprises a frame 10 having two opposite sides, a mirror 11 mounted in the frame 10, a shaft 12 mounted on the frame 10 and having two ends each formed with a threaded rod 121 extended through and protruded from the respective side of the frame 10, two threaded urging members 13 each screwed onto the respective threaded rod 121 of the shaft 12 and each urged on the respective side of the frame 10, two fixing seats 14 each mounted on the respective urging member 13 and each attached to a wall (not shown), and two screw members 15 each screwed onto the respective threaded rod 121 of the shaft 12 and each rested on the respective fixing seat 14 to clamp the respective fixing seat 14.

However, the shaft 12 has two ends each formed with a threaded rod 121 extended through and protruded from the respective side of the frame 10, so that the frame 10 is subjected to a pressure when each of the two threaded urging members 13 is screwed onto the respective threaded rod 121 of the shaft 12 and when each of the two screw members 15 is screwed onto the respective threaded rod 121 of the shaft 12, thereby easily breaking the mirror 11 during assembly. In addition, the frame 10 and the two fixing seats 14 are pressed and fixed by the two threaded urging members 13 and the two screw members 15, so that the frame 10 is easily deformed during assembly, thereby decreasing stability of assembly of the frame 10 and the two fixing seats 14.

SUMMARY OF THE INVENTION

In accordance with the present invention, there is provided a mirror support, comprising a mirror including a frame having two opposite sides each having an inner face and an outer face, a shaft mounted on the frame of the mirror and having two ends each rested on the inner face of the respective side of the frame of the mirror, two connecting members each mounted on the frame of the mirror and each extended through the respective side of the frame of the mirror and secured to the respective end of the shaft, two fixing seats each mounted on the respective connecting member, and two locking members each mounted on the respective fixing seat and each secured to the respective connecting member.

The primary objective of the present invention is to provide an angle adjustable mirror support having an angle adjustable function.

Another objective of the present invention is to provide a mirror support, wherein the shaft has two ends each rested on the inner face of the respective side of the frame of the mirror, so that the shaft is mounted on the frame of the mirror easily and conveniently without the possibility of breaking the mirror face of the mirror.

A further objective of the present invention is to provide a mirror support, wherein the shaft has two ends each rested on the inner face of the respective side of the frame of the mirror so as to reinforce the strength of the frame of the mirror.

A further objective of the present invention is to provide a mirror support, wherein each of the two locking members is directly screwed with the respective connecting member to clamp and fix the respective fixing seat without applying any pressure on the frame of the mirror, thereby preventing the frame of the mirror from being deformed during the assembly process.

A further objective of the present invention is to provide a mirror support, wherein each of the two locking members will not apply any pressure on the frame of the mirror during assembly so that the frame of the mirror is assembled with the fixing seats rigidly and stably.

Further benefits and advantages of the present invention will become apparent after a careful reading of the detailed description with appropriate reference to the accompanying drawings.

DETAILED DESCRIPTION OF THE INVENTION

Figure 1:
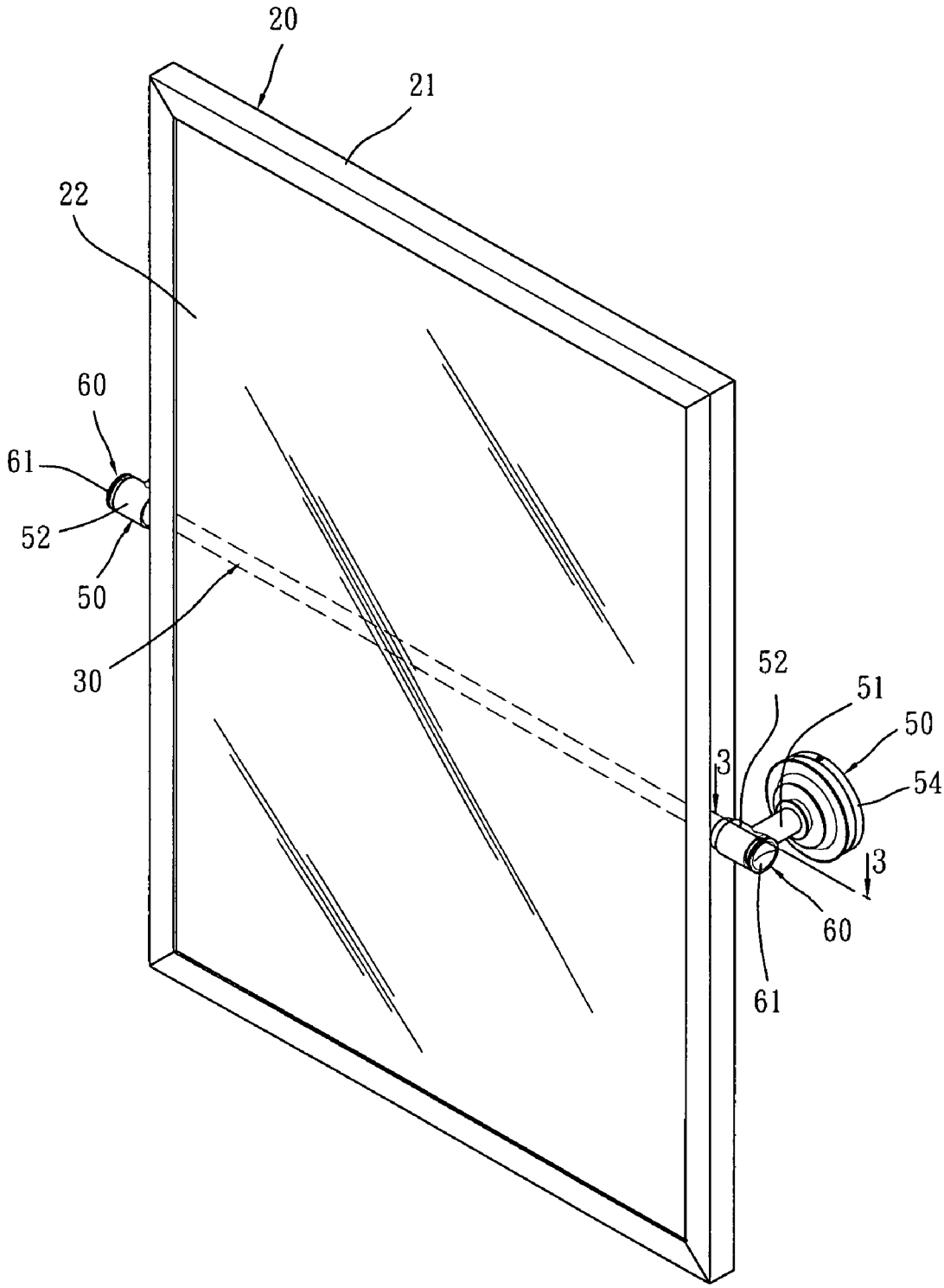
FIG. 1 is a perspective view of a mirror support in accordance with the preferred embodiment of the present invention.
Figure 2:
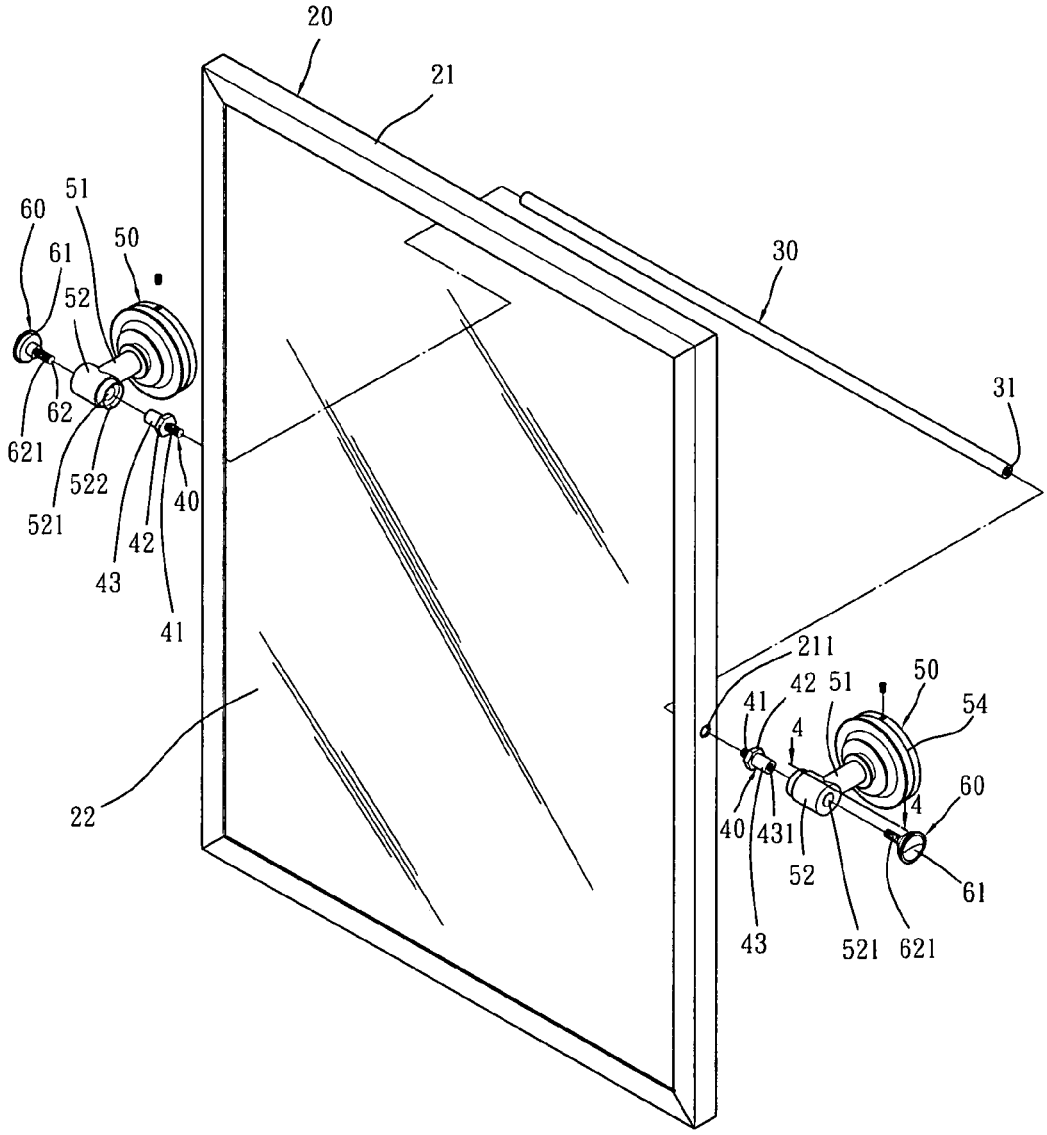
FIG. 2 is an exploded perspective view of the mirror support as shown in FIG. 1.
Figure 3:
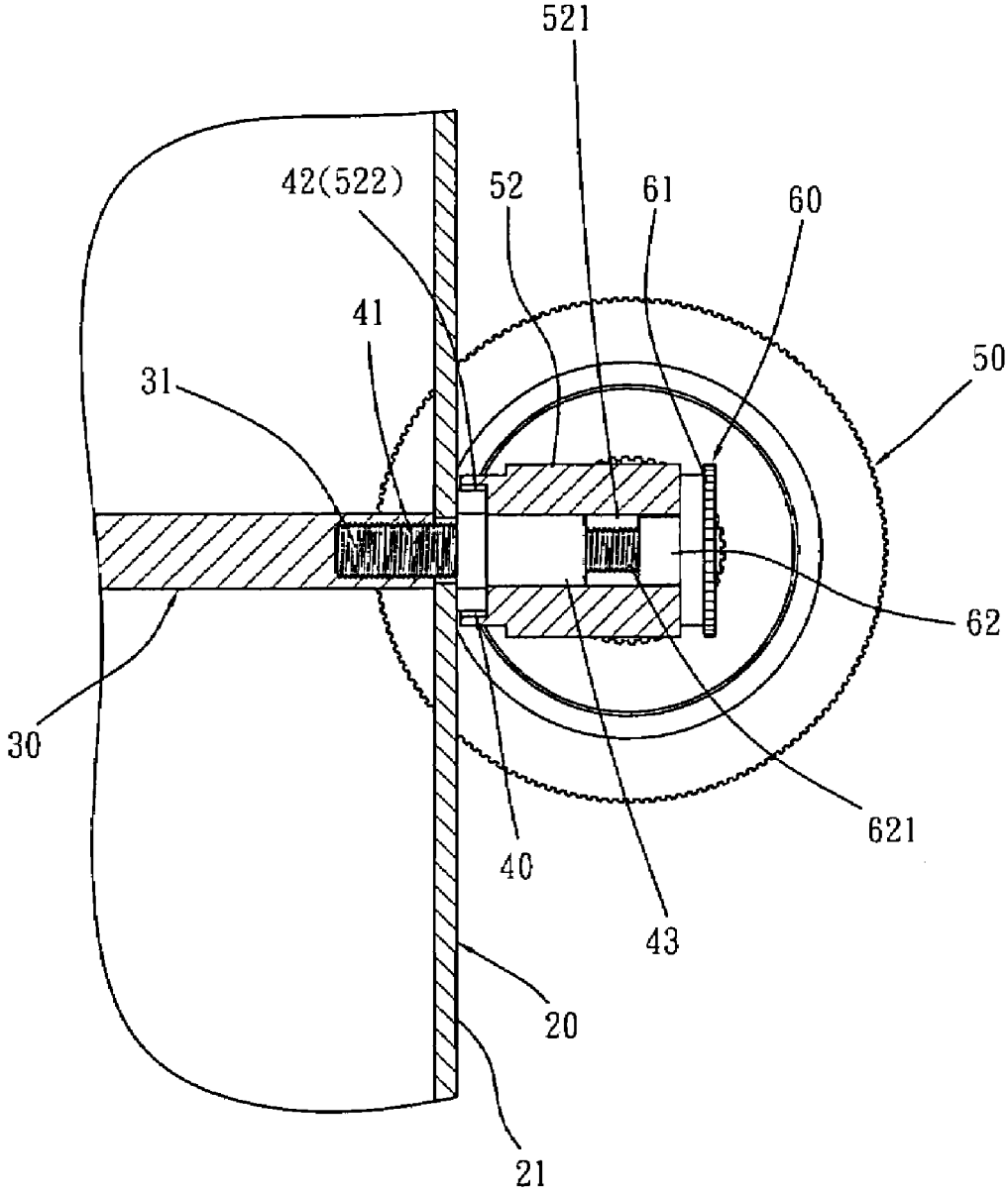
FIG. 3 is a plan cross-sectional view of the mirror support taken along line 3-3 as shown in FIG. 1.
Figure 4:
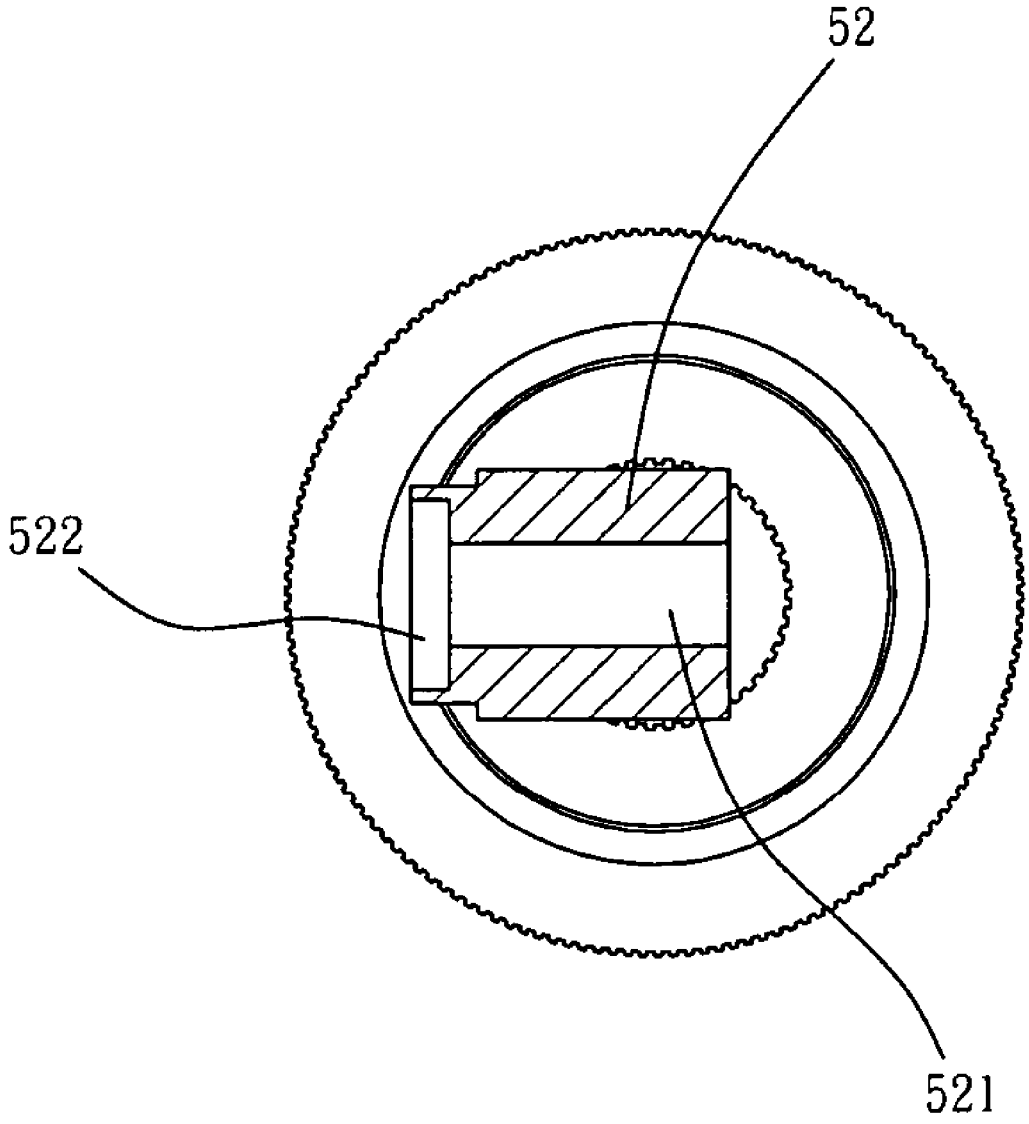
FIG. 4 is a plan cross-sectional view of the mirror support taken along line 4-4 as shown in FIG. 2.

Referring to the drawings and initially to FIGS. 1-4, a mirror support in accordance with the preferred embodiment of the present invention comprises a mirror 20 including a frame 21 having two opposite sides each having an inner face and an outer face, a shaft 30 mounted on the frame 21 of the mirror 20 and having two ends each rested on the inner face of the respective side of the frame 21 of the mirror 20, two connecting members 40 each mounted on the frame 21 of the mirror 20 and each extended through the respective side of the frame 21 of the mirror 20 and secured to the respective end of the shaft 30, two fixing seats 50 each mounted on the respective connecting member 40, and two locking members 60 each mounted on the respective fixing seat 50 and each secured to the respective connecting member 40.

The mirror 20 further includes a mirror face 22 mounted in the frame 21. Each of the two sides of the frame 21 of the mirror 20 has a mediate portion formed with a through hole 211.

The shaft 30 is mounted on a mediate portion of the frame 21 of the mirror 20 and has a length substantially equal to a distance between the two sides of the frame 21 of the mirror 20. Each of the two ends of the shaft 30 has an inside formed with a screw bore 31 aligning with the respective through hole 211 of the frame 21 of the mirror 20.

Each of the two connecting members 40 has a first end formed with a threaded rod 41 extended through the respective through hole 211 of the frame 21 of the mirror 20 and screwed into the respective screw bore 31 of the shaft 30 to position the shaft 30. Each of the two connecting members 40 has a mediate portion formed with a substantially hexagonal rotation head 42 rested on the outer face of the respective side of the frame 21 of the mirror 20 to facilitate a user rotating each of the two connecting members 40. Each of the two connecting members 40 has a second end formed with a connecting rod 43 having an inside formed with a screw bore 431.

Each of the two fixing seats 50 is rested on the outer face of the respective side of the frame 21. Each of the two fixing seats 50 has a first end formed with a substantially cylindrical mounting portion 52 mounted on the respective connecting member 40, a mediate portion formed with a support post 51 and a second end formed with a fixing disk 54 attached to a wall 70 (see FIG. 5). The mounting portion 52 of each of the two fixing seats 50 has an inside formed with a mounting hole 521 mounted on the connecting rod 43 of the respective connecting member 40. The mounting portion 52 of each of the two fixing seats 50 has a first end rested on the outer face of the respective side of the frame 21 and having a periphery formed with a receiving recess 522 to receive the rotation head 42 of the respective connecting member 40. The support post 51 of each of the two fixing seats 50 is perpendicular to the mounting portion 52.

Each of the two locking members 60 is mounted on the mounting portion 52 of the respective fixing seat 50. Each of the two locking members 60 has a first end formed with a stud 62 inserted into the mounting hole 521 of the mounting portion 52 of the respective fixing seat 50 and having a threaded rod 621 screwed into the screw bore 431 of the connecting rod 43 of the respective connecting member 40, so that each of the two fixing seats 50 is clamped and fixed between the respective connecting member 40 and the respective locking member 60. Each of the two locking members 60 has a second end formed with a rotation knob 61 rested on a second end of the mounting portion 52 of the respective fixing seat 50 and rotatable relative to the mounting portion 52 of the respective fixing seat 50.

Figure 5:
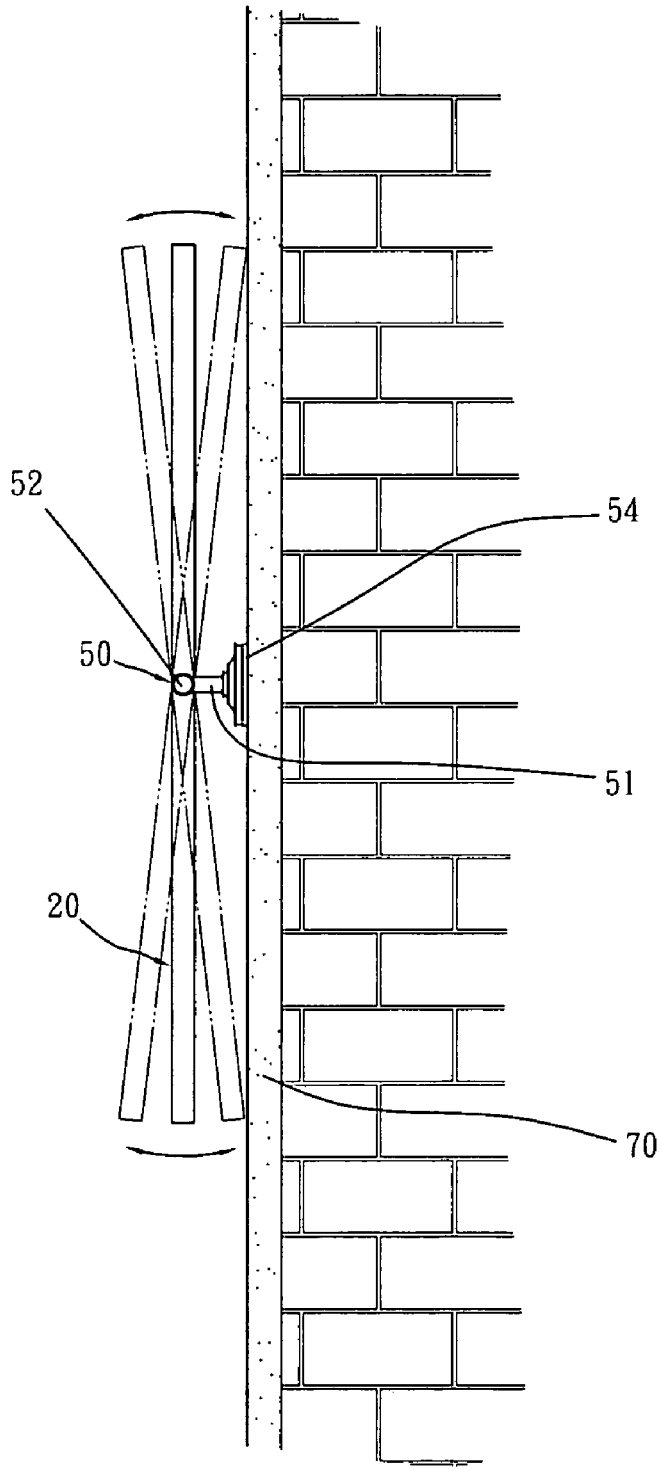
FIG. 5 is a schematic side plan operational view of the mirror support as shown in FIG. 1 in use.
Figure 6:
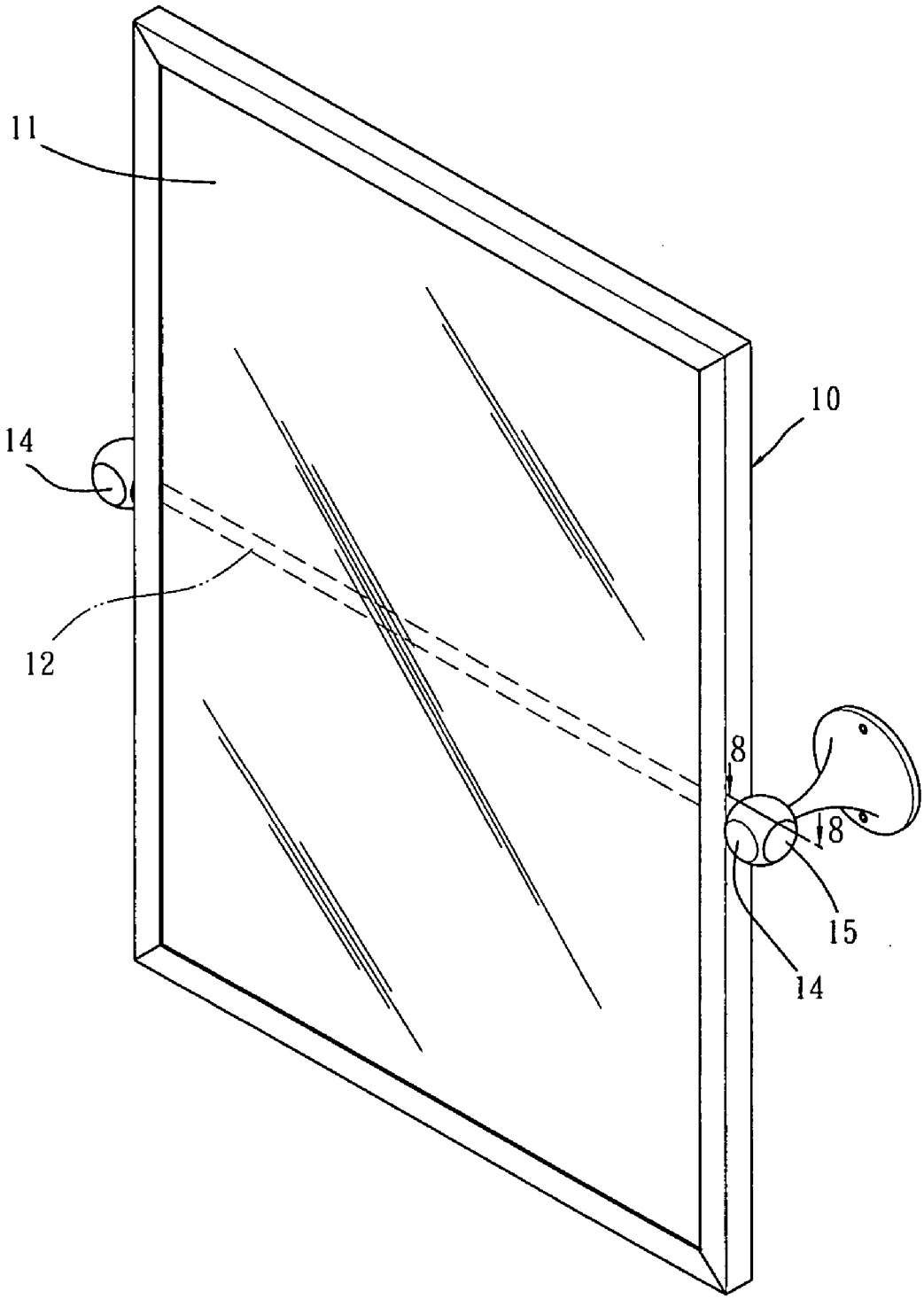
FIG. 6 PRIOR ART
FIG. 6 is a perspective view of a conventional mirror support in accordance with the prior art.
Figure 7:
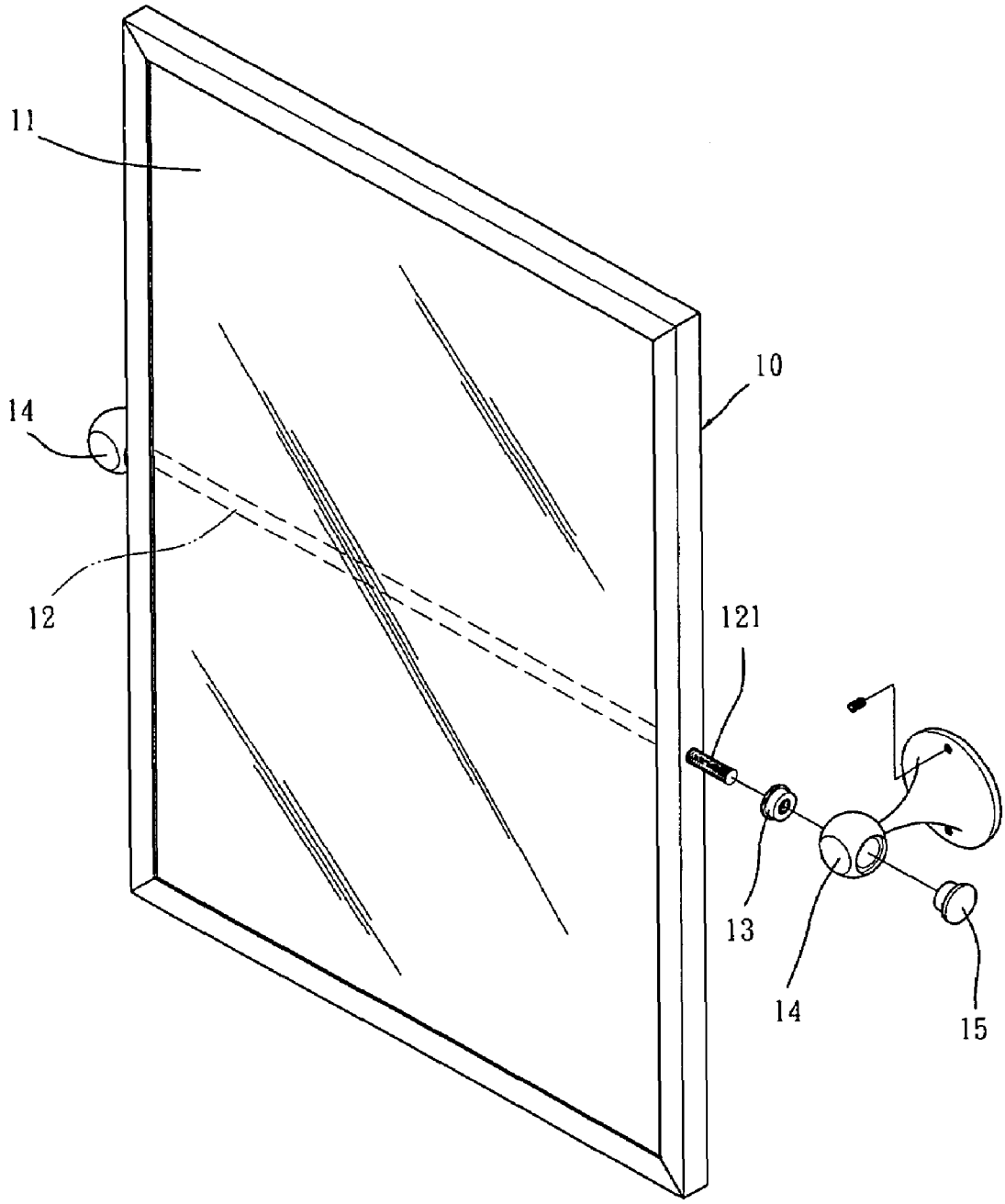
FIG. 7 PRIOR ART
FIG. 7 is an exploded perspective view of the conventional mirror support as shown in FIG. 6.
Figure 8:
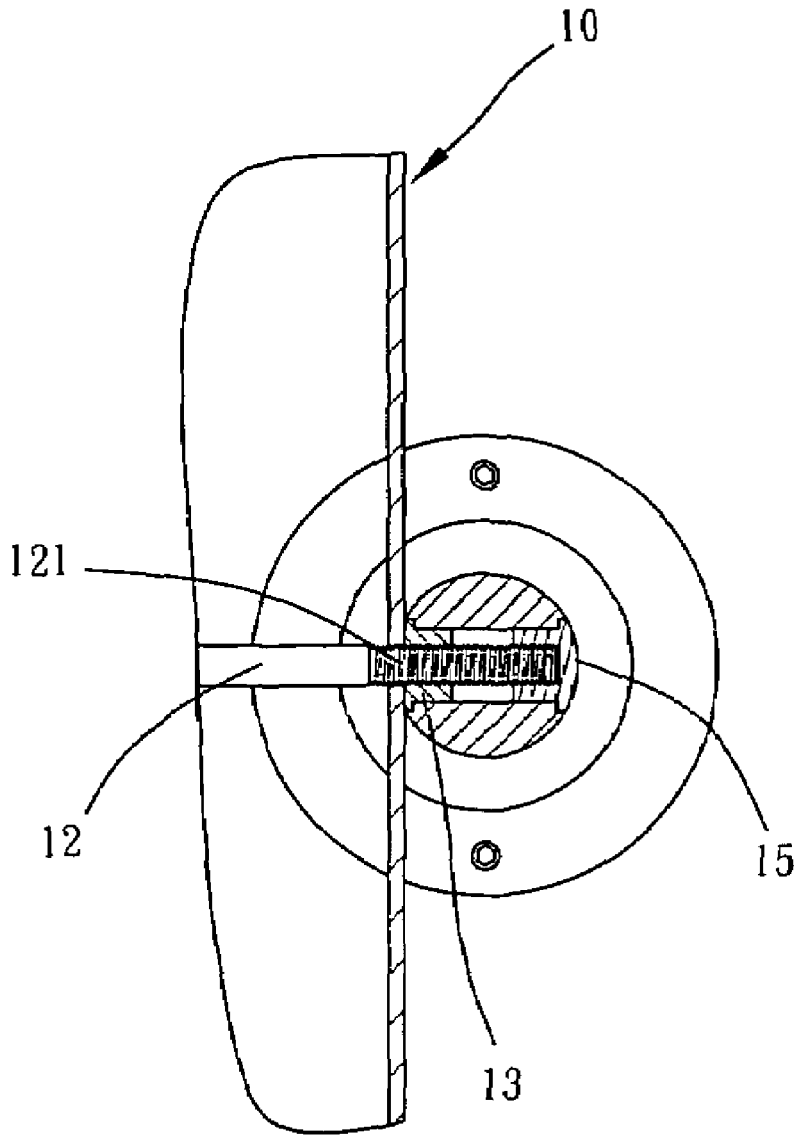
FIG. 8 PRIOR ART
FIG. 8 is a plan cross-sectional view of the conventional mirror support taken along line 8-8 as shown in FIG. 6.

In adjustment, referring to FIGS. 1-5, when the threaded rod 621 of each of the two locking members 60 is unscrewed from the screw bore 431 of the respective connecting member 40 by rotation of the rotation knob 61, each of the two fixing seats 50 is released from the respective connecting member 40 and the respective locking member 60, so that the connecting rod 43 of each of the two connecting members 40 is rotatable in the mounting hole 521 of the mounting portion 52 of the respective fixing seat 50. Thus, each of the two connecting members 40 is rotatable relative to the respective fixing seat 50 after the respective locking member 60 is released, so that of the mirror 20 is rotatable freely between the fixing seats 50 as shown in FIG. 5 so as to adjust the angle of the mirror 20.

Accordingly, the shaft 30 has two ends each rested on the inner face of the respective side of the frame 21 of the mirror 20, so that the shaft 30 is mounted on the frame 21 of the mirror 20 easily and conveniently without having a possibility of breaking the mirror face 22 of the mirror 20. In addition, the shaft 30 has two ends each rested on the inner face of the respective side of the frame 21 of the mirror 20 so as to reinforce the strength of the frame 21 of the mirror 20. Further, each of the two locking members 60 is directly screwed with the respective connecting member 40 to clamp and fix the respective fixing seat 50 without applying any pressure on the frame 21 of the mirror 20, thereby preventing the frame 21 of the mirror 20 from being deformed during the assembly process. Further, each of the two locking members 60 will not apply any pressure on the frame 21 of the mirror 20 during assembly so that the frame 21 of the mirror 20 is assembled with the fixing seats 50 rigidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A mirror support, comprising:

a mirror including a frame having two opposite sides each having an inner face and an outer face;

a shaft mounted on the frame of the mirror and having two ends each rested on the inner face of the respective side of the frame of the mirror;

two connecting members each mounted on the frame of the mirror and each extended through the respective side of the frame of the mirror and secured to the respective end of the shaft, wherein each of the two connecting members has a mediate portion formed with a rotation head rested on the outer face of the respective side of the frame of the mirror to facilitate a user rotating each of the two connecting members;

two fixing seats each mounted on the respective connecting member; and two locking members each mounted on the respective fixing seat and each secured to the respective connecting member.

2. The mirror support in accordance with claim 1, wherein the shaft is mounted on a mediate portion of the frame of the mirror.

3. The mirror support in accordance with claim 1, wherein the shaft has a length substantially equal to a distance between the two sides of the frame of the mirror.

4. The mirror support in accordance with claim 1, wherein the rotation head of each of the two connecting members has a substantially hexagonal shape.

5. The mirror support in accordance with claim 1, wherein each of the two fixing seats is rested on the outer face of the respective side of the frame.

6. A mirror support, comprising:

a mirror including a frame having two opposite sides each having an inner face and an outer face, wherein each of the two sides of the frame of the mirror has a mediate portion formed with a through hole;

a shaft mounted on the frame of the mirror and having two ends each rested on the inner face of the respective side of the frame of the mirror, wherein each of the two ends of the shaft has an inside formed with a screw bore aligning with the respective through hole of the frame of the mirror;

two connecting members each mounted on the frame of the mirror and each extended through the respective side of the frame of the mirror and secured to the respective end of the shaft, wherein each of the two connecting members has a first end formed with a threaded rod extended through the respective through hole of the frame of the mirror and screwed into the respective screw bore of the shaft to position the shaft;

two fixing seats each mounted on the respective connecting member; and two locking members each mounted on the respective fixing seat and each secured to the respective connecting member.

7. The mirror support in accordance with claim 6, wherein each of the two fixing seats has a first end formed with a mounting portion mounted on the respective connecting member.

8. The mirror support in accordance with claim 7, wherein the mounting portion of each of the two fixing seats has a substantially cylindrical shape.

9. The mirror support in accordance with claim 7, wherein each of the two fixing seats has a mediate portion formed with a support post and a second end formed with a fixing disk attached to a wall.

10. The mirror support in accordance with claim 9, wherein the support post of each of the two fixing seats is perpendicular to the mounting portion.

11. The mirror support in accordance with claim 7, wherein each of the two connecting members has a second end formed with a connecting rod having an inside formed with a screw bore, the mounting portion of each of the two fixing seats has an inside formed with a mounting hole mounted on the connecting rod of the respective connecting member, each of the two locking members has a first end formed with a stud inserted into the mounting hole of the mounting portion of the respective fixing seat and having a threaded rod screwed into the screw bore of the connecting rod of the respective connecting member, so that each of the two fixing seats is clamped and fixed between the respective connecting member and the respective locking member.

12. The mirror support in accordance with claim 11, wherein the mounting portion of each of the two fixing seats has a first end rested on the outer face of the respective side of the frame and having a periphery formed with a receiving recess to receive a rotation head on a mediate portion of the respective connecting member.

13. The mirror support in accordance with claim 12, wherein each of the two locking members has a second end formed with a rotation knob rested on a second end of the mounting portion of the respective fixing seat and rotatable relative to the mounting portion of the respective fixing seat.

14. The mirror support in accordance with claim 11, wherein when the threaded rod of each of the two locking members is unscrewed from the screw bore of the respective connecting member, each of the two fixing seats is released from the respective connecting member and the respective locking member, so that the connecting rod of each of the two connecting members is rotatable in the mounting hole of the mounting portion of the respective fixing seat.

15. The mirror support in accordance with claim 14, wherein each of the two connecting members is rotatable relative to the respective fixing seat after the respective locking member is released, so that of the mirror is rotatable between the fixing seats so as to adjust the angle of the mirror.

16. The mirror support in accordance with claim 7, wherein each of the two locking members is mounted on the mounting portion of the respective fixing seat.

* * * * *